United States Patent [19]

Huth

[11] Patent Number: 4,806,281

[45] Date of Patent: Feb. 21, 1989

[54] LUBRICATING OIL ADDITIVE AND METHOD AND APPARATUS FOR MAKING SAME

[76] Inventor: Malte Huth, Pschorstrasse 5, 8133 Feldafing, Fed. Rep. of Germany

[21] Appl. No.: 48,942

[22] Filed: May 12, 1987

[30] Foreign Application Priority Data

Dec. 13, 1986 [DE] Fed. Rep. of Germany ..... 3642617

[51] Int. Cl.[4] ..... C10M 125/18

[52] U.S. Cl. ..... 252/58

[58] Field of Search ..... 252/58

[56] References Cited

U.S. PATENT DOCUMENTS 3,432,511 3/1969 Reiling ..... 252/58

4,224,173 9/1980 Reick ..... 252/58

*Primary Examiner*—William R. Dixon, Jr.

*Assistant Examiner*—Jerry D. Johnson

*Attorney, Agent, or Firm*—Cushman, Darby & Cushman

[57] ABSTRACT

A method for producing a dispersion of polytetrafluoroethylene in lubricating oil or a lubricating oil additive. A non-ionic wetting agent is mixed with a dispersion of polytetrafluoroethylene in oil, and the resulting mixture is subjected to a heat treatment in several zones starting with a shock treatment, and followed by several zones of progressively lower temperature.

9 Claims, 1 Drawing Sheet

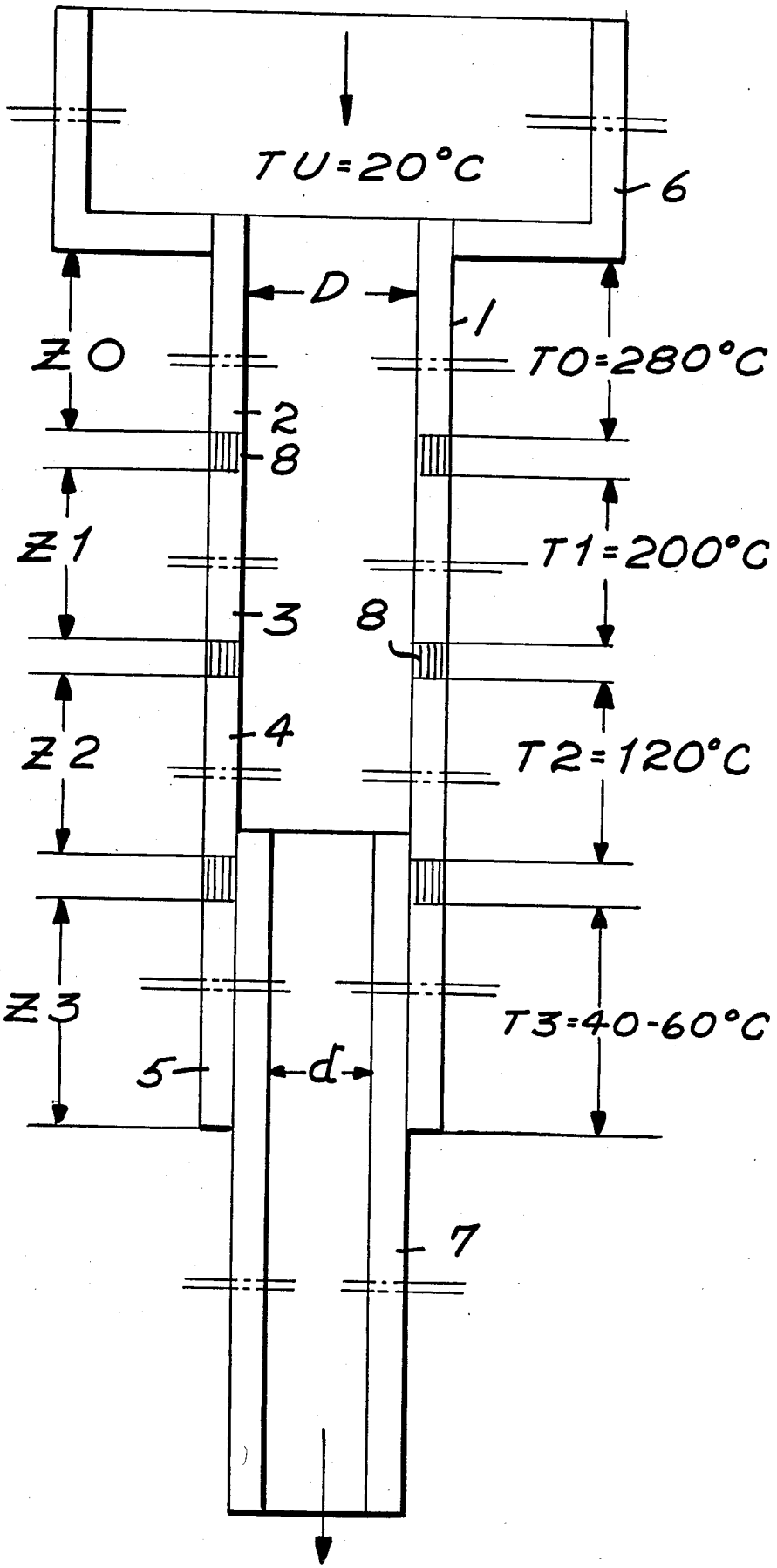
TU=20°C
6
D
1
Z0
T0=280°C
2
8
Z1
T1=200°C
3
8
4
Z2
T2=120°C
Z3
T3=40-60°C
5
d
7

LUBRICATING OIL ADDITIVE AND METHOD AND APPARATUS FOR MAKING SAME

The present invention relates to a dispersion of polytetrafluoroethylene (PTFE) in powdered form, in a commercial mineral oil. Such dispersions are useful as lubricating oil additives. The invention also relates to a method of producing such a dispersion.

BACKGROUND OF THE INVENTION

Many types of dispersions of PTFE in oil are commercially available. PTFE has an extremely low coefficient of friction, and this property makes it useful as an additive for lubricating oils, e.g. engine oil or transmission oil. Additives containing PTFE are also helpful in reducing wear in machine guides, threads or similar applications in which parts subject to friction are exposed to high loads.

One problem with PTFE dispersions is that PTFE also is non-adhesive. In dispersions of PTFE in oil, an electrostatic charge develops on the PTFE particles, and this charge causes a repulsion vis-a-vis the metal surface to be lubricated.

It also is known that the wetting capacity of a PTFE dispersion can be improved by the addition of wetting agents. However, cationic dispersants readily result in coagulation of PTFE dispersions, especially dispersions in oils.

Accordingly, the PTFE particles of conventional oils treated with PTFE dispersions are not distributed over the surfaces to be lubricated in the desired, fine, film-like distribution.

SUMMARY OF THE INVENTION

The object of the present invention is to provide a method of producing a PTFE dispersion in oil which exhibits the desired film formation on metallic surfaces.

In accordance with the present invention, a non-ionic surface tension reducing agent or wetting agent is mixed with a dispersion of PTFE in mineral oil as an antistatic agent, and the dispersion is subjected to a heat treatment which causes a permanent attachment of the antistatic agent to the particles of PTFE. The dispersion is passed through a flow conduit in which it is first flowed through a shock zone at a maximum temperature, up to the decomposition temperature of the antistatic agent. Then the mixture is flowed through one or more tempering zones in the flow conduit, with progressively lower temperatures. Preferably, there are two to four temperature zones, after the shock zone, and the last zone is at a temperature of 40° to 60° C. More preferably, there are three zones after the shock zone, and the temperatures in the first and second zones are about 200° C. and 120° C. respectively. Desirably, these zones are followed by an abatement zone in which the liquid flows through a PTFE tube or a PTFE-lined tube at ambient temperature. The PTFE tube preferably extends into the flow conduit to prevent contact of the treated dispersion with the steel sections of the flow conduit in the areas of relatively low temperature. The PTFE tube may extend as far as the first tempering zone. If three tempering zones are used, for example, the PTFE tube advantageously extends into the middle tempering zone. This prevents wetting contact between the PTFE particles in the liquid with steel surfaces before it is poured into plastic containers.

The wetting agent, which is a conductivity additive, becomes permanently attached to the PTFE particles through this treatment, and this causes the build-up of static charges on the particles to be prevented or considerably reduced. This in turn enhances the adhesion of the PTFE particles to metal surfaces. The PTFE particles are in a neutral state, and this causes them to cling to the cathodic metal surface, where they form a thin film which reduces friction to a greater extent than has been possible previously.

The heat treatment also dissolves or separates the agglomerates present in the untreated mixture. This makes it possible for the PTFE to form a thin film over the lubricated metal surfaces.

BRIEF DESCRIPTION OF FIGURES OF DRAWING

The drawing is a cross section, partially schematic, through an apparatus for carrying out the invention.

DETAILED DESCRIPTION OF PREFERRED EMBODIMENTS

A suitable apparatus for carrying out the invention is illustrated in the drawing.

In the apparatus shown in the drawing, a flow conduit 1 extends downwardly from a reservoir 6, and has four sections 2, 3, 4 and 5, separated from each other by thermal insulators 8. The uppermost section 2 is connected directly to the reservoir or funnel 6. A tube 7 is inserted into the lower portion of the conduit, providing an abatement section. The tube 7 may be made of PTFE. It also may be made of another material, if it is lined with PTFE. PTFE is preferred for the tube because it assures the electroneutral properties of the dispersion. The tube 7 empties into a plastic container, not shown.

The four sections 2, 3, 4 and 5 are provided with heaters and temperature controls (not shown) for independently regulating the temperatures of the four sections. Apparatus of the type used in extruders is suitable.

The individual sections 2, 3, 4 and 5 of the flow conduit 1 can have approximately equal lengths, and the overall length may be one meter or more. The diameters of the flow conduit and the PTFE tube should be selected so that the liquid achieves the temperature of the respective sections before flowing on to the next sections. The diameters of the conduit and the tube control the flow rate of the liquid. For example, the internal diameter D of the conduit may be approximately twice the diameter of the PTFE tube, and the diameter of the PTFE tube may be approximately 10 mm, when the flowrate is 2–5 liters per minute.

Upper section 2 is a shock zone $Z_o$ which may have a temperature of approximately 280° C. The next section 3 is the first tempering zone $Z_1$ which may have a temperature $T_1$ of approximately 200° C. Section 4 forms a central tempering zone $Z_2$ which may have a temperature $T_2$ of approximately 120° C. The lowest section 5 provides the last tempering zone $Z_3$ which may havae a temperature $T_3$ of approximately 40°–60° C.

The PTFE tube 7 is inserted into the flow conduit 1 from below so that it forms a seal with the inner wall of the lowest section 5 of the conduit and the lower portion of the next-to-the-last section 4 of the conduit. PTFE tube 7 is calibrated in such manner that it controls the desired throughput of the dispersion.

The process of the invention is carried out by placing a dispersion of PTFE in mineral oil, containing a non-ionic wetting agent, in the reservoir 6 at ambient temperature, for example 20° C., and causing it to flow through the flow conduit 1. The mixture can be supplied in batches or continuously. If desired, the treated oil can be recycled for more than one treatment. In the flow conduit, the temperature is progressively changed in a series of temperature zones, corresponding to the desired heat treatment, followed by passing through the lower portion of the tube 7 at ambient temperature.

The particles of the PTFE powder used in the invention should be as small as possible. Preferably, the particle size of the PTFE agglomerates is between 0.1 and 1.0 micrometer. Tests with a scanning electron microscope showed the particle size of a suitable material to be 0.2 to 0.3 micrometers.

The liquid component of the dispersion may be any mineral oil, conventional motor oil or transmission oil. Preferably it is a paraffin-based mineral oil with conventional additives.

The non-ionic wetting agent additive may be, for example, nonylphenol polyglycol ether, which is available from the firm Hoechst under the tradename "Arkopal". With this material, the maximum temperature in the shock zone is 280° C.

The proportions of the PTFE and the wetting agent may be selected with a view to producing a finished lubricating oil or an additive which can be blended into a lubricating oil before use. The desired proportions of PTFE are preferably 0.05 to 2 percent by weight, based on the weight of the lubricating oil. If an additive is being made, the proportion will be higher, to take into account the amount of dilution which will occur when the additive is blended with oil. The proportion of wetting agent is, for example, 10 to 30 percent, based on the weight of PTFE.

EXAMPLE

A suitable lubricating oil additive in accordance with the invention can be made as follows:

Ten parts by weight of a mineral oil is blended with 0.5 parts by weight Arkopal, and 2 parts by weight of PTFE powder is stirred with the mixture until a homogeneous paste is obtained. Then the paste is agitated with 87.5 parts by weight mineral oil. The liquid mixture obtained in this way is then subjected to a heat treatment in the apparatus described above, using the temperatures specified above.

The resulting additive may then be used by mixing it with a motor oil in a ratio of 1 part additive to 4 parts oil.

The effectiveness of the treatment provided by the present invention was confirmed by tests. Specimens of metal coated with a lubricating additive produced in accordance with the present invention were examined under an electron microscope. When irradiated with electrons, the electronic reflection showed non-sharp contours of the metal surface, caused by the PTFE film on the metal surface. In another test, the electron beam of a scanning electron microscope was used, which caused the elements located on the metal surface to emit a characteristic X-radiation. The diagrams obtained showed a section of the entire spectrum in the wavelength region for fluorine, which is an element of PTFE, thereby establishing the presence of PTFE on the metal.

Wear tests using the radioisotope method confirmed the wear-reducing action of the lubricating oil additive of the invention. There was a reduction of wear of 54% on a tested piston ring sliding surface two hours after the addition of the lubricating oil additive of the invention.

It will be understood that the invention has been described by reference to a preferred embodiment, which has been used for purposes of illustration only. Changes may be made in details of construction and composition, and in mode of operation, without departing from the invention, whose scope is defined in the claims.

What is claimed is:

1. A method for producing a dispersion of polytetrafluoroethylene in oil which comprises forming a mixture comprising polytetrafluoroethylene powder dispersed in oil which also contains a non-ionic wetting agent, subjecting the mixture to a shock heat treatment in which the oil is transferred into a zone heated at a temperature above 200° C. up to the decomposition temperature of the non-ionic wetting agent, and then subjecting the mixture to one or more tempering treatments at progressively lower temperatures.

2. A method as set forth in claim 1 in which the non-ionic wetting agent is nonylphenol glycol ether and the maximum temperature is 280° C.

3. A method according to claim 2 in which there are two to four tempering treatments and the temperature of the last tempering treatment is 40°-60° C.

4. A method as set forth in claim 2 in which there are three tempering treatments, and the temperatures of the tempering treatments are respectively approximately 200° C., 120° C. and 40°-60° C.

5. A method as set forth in any one of claims 1-4 in which the successive heat treatments are carried out by passing the mixture through a flow conduit heated in successive zones to the shock treatment temperature and the tempering treatment temperatures.

6. A method as set forth in claim 5 in which the mixture is flowed through a temperature abatement zone at ambient temperature, after leaving the last tempering treatment zone, and the temperature abatement zone comprises a tube having an inner surface of polytetrafluoroethylene.

7. A method as set forth in claim 6 in which the said tube having an inner surface of polytetrafluoroethylene extends into at least a portion of the last tempering zone so that the mixture is in contact with polytetrafluoroethylene when it is subjected to the last tempering treatment.

8. A method according to claim 5 in which the flow conduit is vertical.

9. A dispersion produced by the method of claim 1.

* * * * *